US006553983B1

(12) United States Patent
Li

(10) Patent No.: US 6,553,983 B1
(45) Date of Patent: Apr. 29, 2003

(54) PAINT BALL GUN

(76) Inventor: Kao-Ming Li, No. 69, Lane 249, Lin-An Road, Sec. 2, Tainan (TW)

( * ) Notice: Subject to any disclaimer, the term of this patent is extended or adjusted under 35 U.S.C. 154(b) by 0 days.

(21) Appl. No.: 10/086,385

(22) Filed: Mar. 4, 2002

(51) Int. Cl.[7] ..... F41B 11/32
(52) U.S. Cl. ..... 124/73; 124/76
(58) Field of Search ..... 124/60, 73, 74, 124/76, 72

(56) References Cited

U.S. PATENT DOCUMENTS 4,004,566 A * 1/1977 Fischer ..... 124/59
5,063,905 A * 11/1991 Farrell ..... 124/72
5,333,594 A * 8/1994 Robinson ..... 124/73
5,462,042 A * 10/1995 Greenwell ..... 124/76
5,967,133 A * 10/1999 Gardner, Jr. ..... 124/77
6,003,504 A * 12/1999 Rice et al. ..... 124/73
6,142,136 A * 11/2000 Velasco ..... 124/71
6,360,736 B1 * 3/2002 Juan ..... 124/77
6,371,099 B1 * 4/2002 Lee ..... 124/66

* cited by examiner

*Primary Examiner*—Charles T. Jordan
*Assistant Examiner*—John W. Zerr
(74) *Attorney, Agent, or Firm*—Rosenberg, Klein & Lee

(57) ABSTRACT

A paint ball gun comprises a receiver including an upper compartment and a lower compartment. A bolt is slidably mounted in the upper compartment and includes a chamber in a front end thereof for receiving a bolt pin. A gas control device is mounted in the lower compartment and includes a valve assembly, a striker, and a striker spring, the bolt and the striker being connected together to move jointly. The valve assembly comprises a positioning sleeve secured in the lower compartment, a valve pin, a valve spring mounted in the positioning sleeve, a seal member mounted to a front end of the positioning sleeve, and a cap secured to an end of the valve pin. The valve pin extends through the valve spring and located in the positioning sleeve. The valve pin includes a rear end extending beyond a hole in a rear end of the positioning sleeve.

2 Claims, 6 Drawing Sheets

PAINT BALL GUN

BACKGROUND OF THE INVENTION

1. Field of the Invention

The present invention relates to a paint ball gun providing an improved accuracy.

2. Description of the Related Art

FIG. 6 of the drawings illustrates a conventional paint ball gun comprising a receiver 70 with an upper compartment 71 and a lower compartment 72 parallel to the upper compartment 71. A ball-feeding tube 73 is attached to a side of the receiver 70. A barrel 74 is attached to a front end of the upper compartment 71. A venturic bolt 75 is mounted in the upper compartment 71. A gas control device 77 is mounted in the lower compartment 72 and includes front striker plug 771, a valve body 90, a striker 772, and a rear striker plug 774. A passageway 79 is provided between the upper compartment 71 and the lower compartment 72. A connecting member 78 is provided to connect the striker 772 with the venturic bolt 75 to allow joint movement. A grip means 80 is attached to an underside of the receiver 70 and includes a trigger 81 and a grip 82. An adaptor 83 is attached to a lower side of the grip 82 for attachment of a container containing pressurized gas or the like. The adaptor 83 is communicated with a gasifier 85 via a tube 84.

In firing, when the trigger 81 is pulled to a firing position, gas is fed to the gasifier 85 and then enters a space between the front striker plug 771 and the valve body 90 through a reservior 86 in a front end of the lower compartment 72. The venturic bolt 75 and the striker 772 are moved rearward and then positioned. At this time, a paint ball 94 is fed into the upper compartment 71 through the ball-feeding tube 73 and located in front of the venturic bolt 75. When the trigger 81 is pulled further rearward, the stored energy of the striker spring 773 is released and thus moves the striker 772 to impact the valve pin 91 of the valve body 90. Thus, the valve pin 91 moves forward and compresses the valve spring 93 between the front striker plug 771 and the valve body 90. The pressurized gas enters the valve body 90 and then a chamber 751 in the venturic bolt pin 75 through an orifice 92. Then, the pressurized gas impacts the paint ball 94 after passing through passageways between the wings 761 of the venturic bolt pin 76. Thus, the paint ball 94 is fired through the barrel 74. At the moment of firing, the trigger 81 releases the stored energy of the striker spring 773 to urge the striker 772 to impact the valve pin 91 of the valve body 90. The valve spring 93 between the front striker plug 771 and the valve body 90 is compressed rapidly and thus releases the pressurized gas. Thus, the pressurized gas impacts the paint ball 94 and moves the striker 772 rearward for next firing.

However, flexibility of the valve spring 93 mounted between the front striker plug 771 and the valve body 90 adversely affects returning of the valve pin 91. The gas flowing through the passageways between the wings 761 of the venturic bolt pin 76 located in the compartment 751 of the venturic bolt 75 diverts and thus could not provide a balanced impact force for firing the paint ball 94. As a result, the accuracy of the fired paint ball 94 is adversely affected.

SUMMARY OF THE INVENTION

An object of the present invention is to provide a paint ball gun providing an improved accuracy.

A paint ball gun in accordance with the present invention comprises:

a receiver including an upper compartment and a lower compartment parallel to the upper compartment;

a barrel attached to a front end of the upper compartment;

a ball-feeding tube attached to a side of the receiver for feeding a paint ball into the upper compartment;

a bolt slidably mounted in the upper compartment and including a chamber in a front end thereof;

a bolt pin mounted in the chamber of the bolt;

a gas control device mounted in the lower compartment and including a front striker plug, a valve assembly, a striker, a striker spring, and a rear striker plug, the bolt and the striker being connected together to move jointly;

an orifice defined between the upper compartment and the lower compartment; and a trigger operably connected to the striker spring;

the valve assembly comprising a positioning sleeve secured in the lower compartment, a valve pin, a valve spring mounted in the positioning sleeve, a seal member, and a cap, the valve pin extending through the valve spring and located in the positioning sleeve, the valve pin including a rear end extending beyond a hole in a rear end of the positioning sleeve, the positioning sleeve including a front end to which the seal member is mounted, the valve pin including a front end extending beyond the seal member with the cap securely attached to the front end of the valve pin to move therewith;

the valve pin being actuated forward by the striker when the trigger is pulled beyond a predetermined position, the cap being moved away from the seal member to allow gas from the front striker plug to enter the positioning sleeve, a portion of the gas entering the chamber of the bolt through the orifice for firing the paint ball through the barrel, another portion of the gas exiting the hole in the rear end of the positioning sleeve to move the striker rearward.

The positioning sleeve includes an inner threading in a front end thereof and a vent in an outer periphery thereof. The front end of the valve pin includes an outer threading. The rear end of the valve pin includes a beveled section with a beveled face for providing a passageway to the vent. A stop is formed on the beveled section. The seal member includes a flange on an inner periphery of a front end thereof. The seal member further includes a threaded section on an outer periphery thereof for engaging with the inner threading of the positioning sleeve. The valve spring includes a rear end attached to the stop and a front end attached to the flange of the seal member. A washer is mounted around the front end of the valve pin and located in the cap. The cap includes an inner threading for engaging with the outer threading of the valve pin.

The bolt pin includes a first end and a reduced second end. A conic portion is formed between the first end and the reduced second end of the bolt pin. A concave face is defined in the first end of the bolt pin. The reduced second end of the bolt pin is securely engaged in the chamber of the bolt. At least one longitudinal passageway is defined between the conic portion and the concave face of the bolt pin. The paint ball is fired by the portion of the gas passing through the orifice and the longitudinal passageway.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
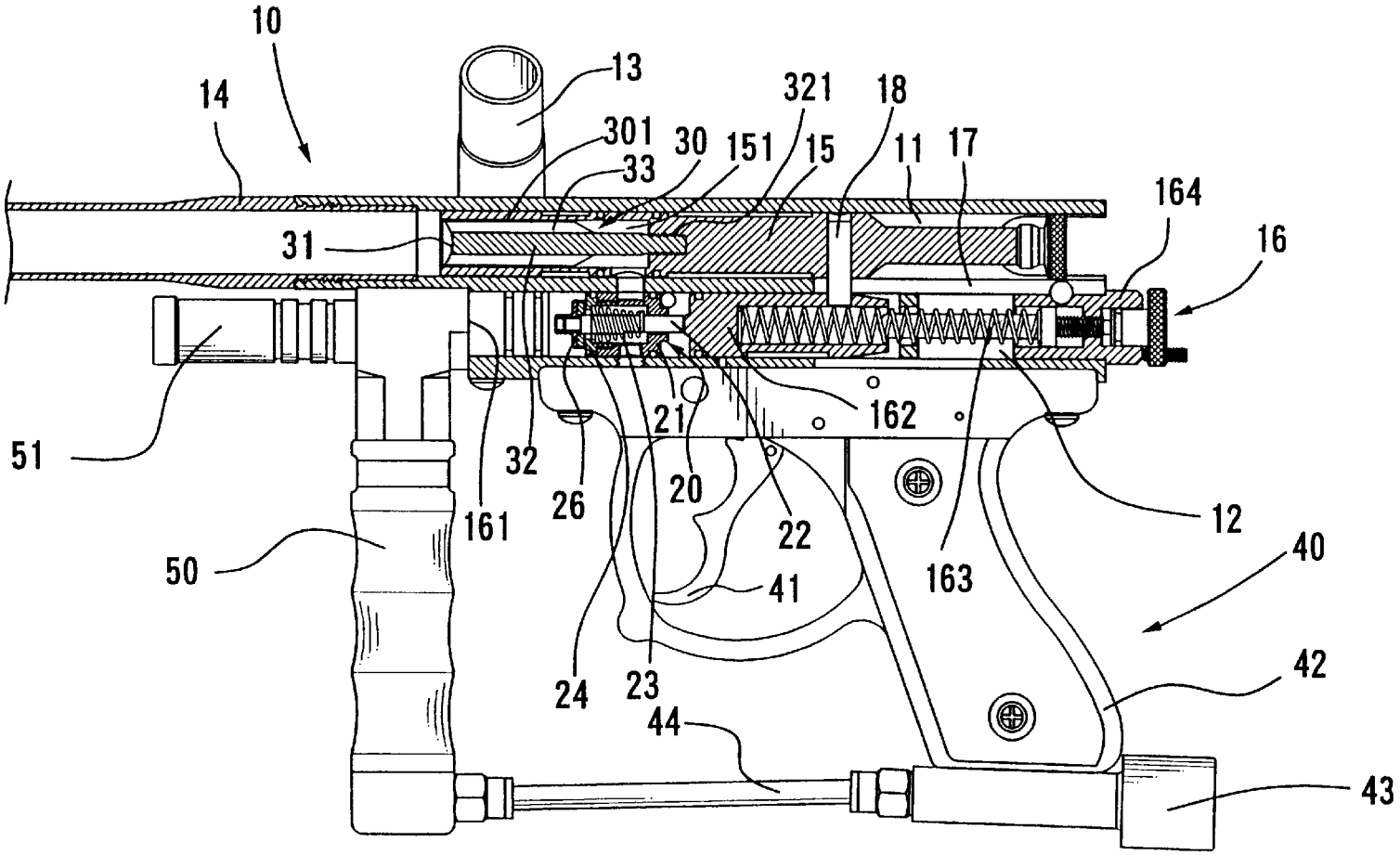
FIG. 1 is a sectional view of a paint ball gun in accordance with the present invention.

Referring to FIG. 1, a paint ball gun in accordance with the present invention generally comprises a receiver 10 having an upper compartment 11 and a lower compartment 12 parallel to the upper compartment 11. A barrel 14 is attached to a front end of the upper compartment 11. A ball-feeding tube 13 is attached to a side of the receiver 10 for feeding a paint ball 60 (FIG. 4), one at a time, into the upper compartment 11. A bolt 15 (e.g., a venturic bolt) is mounted in the upper compartment 11. A gas control device 16 is mounted in the lower compartment 12 and includes a front striker plug 161, a valve assembly 20, a striker 162, a striker spring 163, and a rear striker plug 164. A passageway 17 is provided to communicate the lower compartment 12 with the upper compartment 11. A connecting member 18 is mounted in the passageway 17 for connecting the venturic bolt 15 with the striker 162, thereby allowing joint movement of the venturic bolt 15 and the striker 162.

The paint ball gun further comprises a grip means 40 including a grip 42 and a trigger 41. An adaptor 43 is attached to a lower side of the grip 42 for attachment of a container (no shown) containing pressurized gas or the like. The adaptor 43 is communicated with a gasifier 50 via a tube 44. A reservoir 51 is provided in front of the gasifier 50 for storing pressurized gas or the like.

Figure 2:
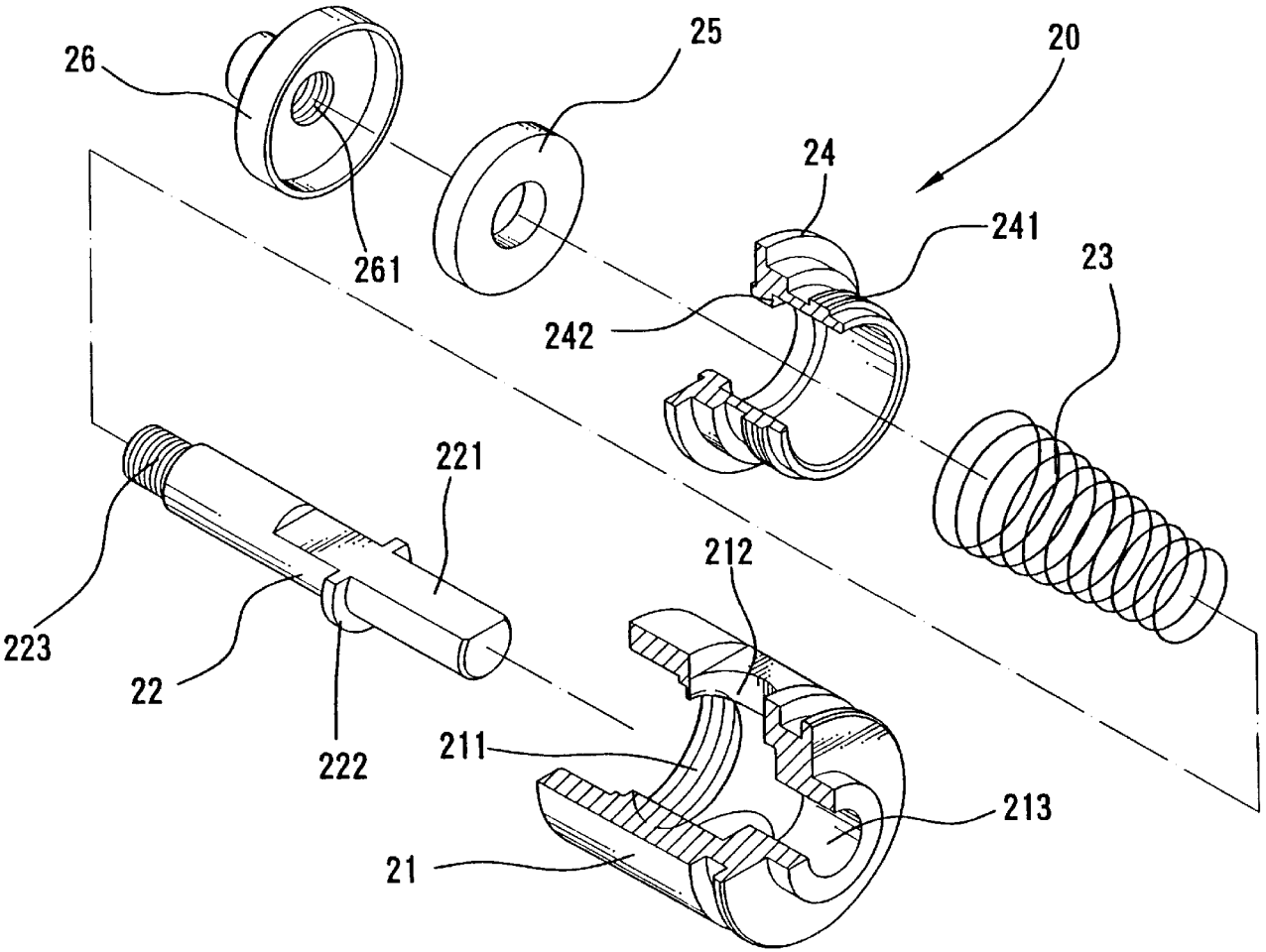
FIG. 2 is an exploded perspective view of a valve assembly of the paint ball gun in accordance with the present invention.

The present invention is featured by the valve assembly 20 of the gas control device 16. As illustrated in FIGS. 1 and 2, the valve assembly 20 comprises a positioning sleeve 21, a valve pin 22, a valve spring 23, a seal member 24, a washer 25, and a cap 26. The positioning sleeve 21 includes an inner threading 211 in a front end thereof and a hole 213 in a rear end thereof. A vent 212 is defined in a periphery of the positioning sleeve 21 and communicated with the hole 213.

The valve pin 22 includes an outer threading 223 on a front end thereof and a beveled face 221 on a rear end thereof. A stop 222 is formed on the rear end of the valve pin 22 and located in the beveled area of the valve pin 22. A rear end of the valve spring 23 is attached to the stop 222. The rear end 22 of the valve pin 22 is extended through the hole 213 of the positioning sleeve 21. The beveled face 221 of the valve pin 22 provides a passageway for the pressurized gas to the vent 212.

The seal member 24 includes a threaded section 241 on an outer periphery thereof for engaging with the inner threading 211 of the positioning sleeve 21. Provided on an inner periphery of a front end of the seal member 24 is a flange 242 to which a front end of the valve spring 23 is attached. The front end of the valve pin 22 is extended through the washer 25 with the outer threading 223 of the valve pin 22 being engaged with an inner threading 261 of the cap 26.

Figure 3:
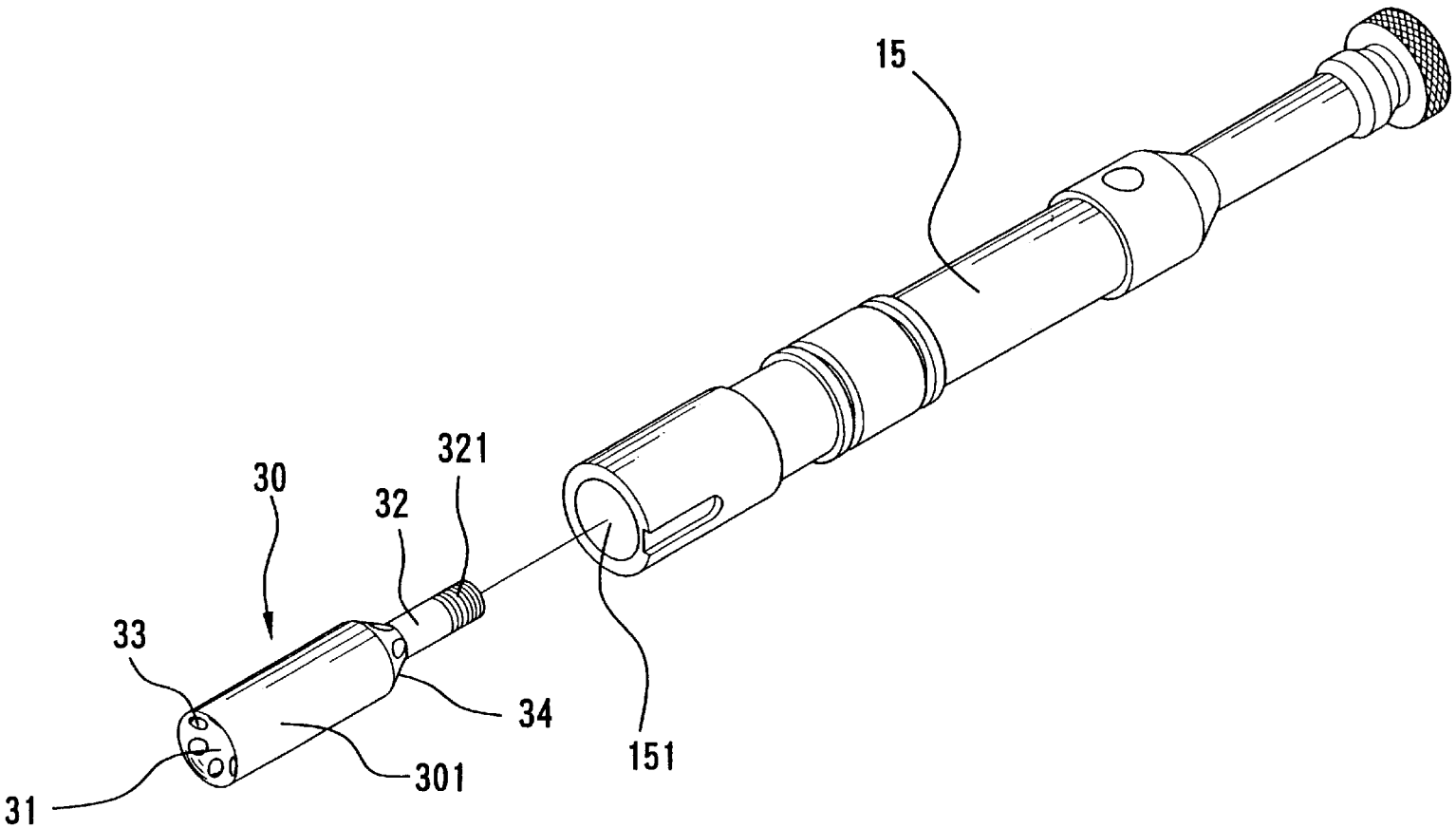
FIG. 3 is a perspective view of a venturic bolt and a venturic bolt pin of the paint ball gun in accordance with the present invention.

Another feature of the paint ball gun in accordance with the present invention is a bolt pin 30 (e.g., a venturic bolt pin) mounted in a chamber 151 in a front end of the venturic bolt 15. As illustrated in FIGS. 1 and 3, the venturic bolt pin 30 includes a solid body 301 having a concave face 31 in a front end thereof. A rear end of the body 301 is in the form of a reduced locking rod 32 having a threaded portion 321. Plural longitudinal passageways 33 are defined between the concave face 31 and a conic portion 34 between the front end and the rear end of the body 301. The venturic bolt pin 30 is mounted in the chamber 151 of the venturic bolt 15 with the threaded portion 321 of the body 30 engaged in an end wall defining the chamber 151.

Figure 4:
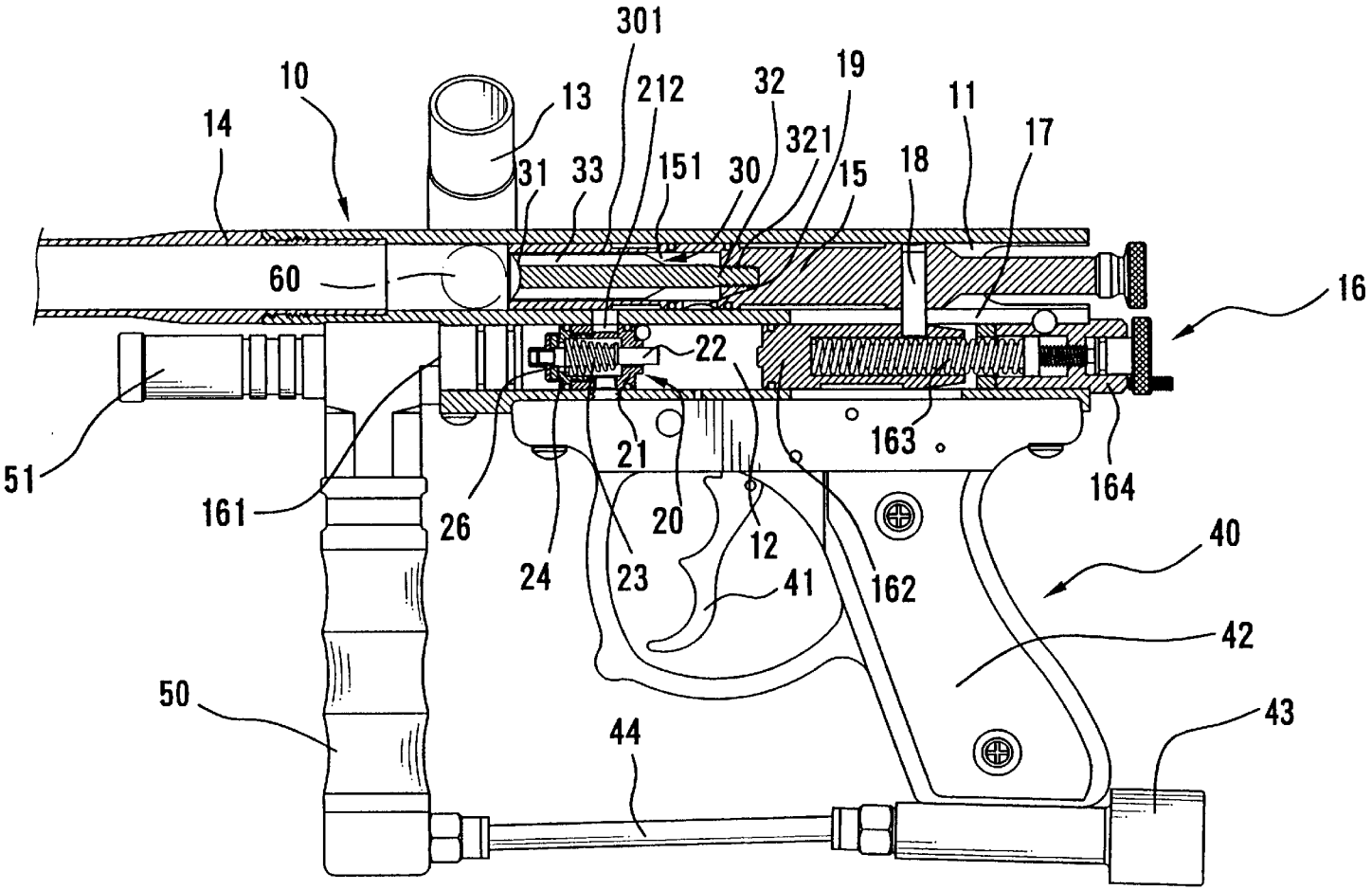
FIG. 4 is a sectional view similar to FIG. 1, illustrating a first stage of firing of a paint ball.
Figure 5:
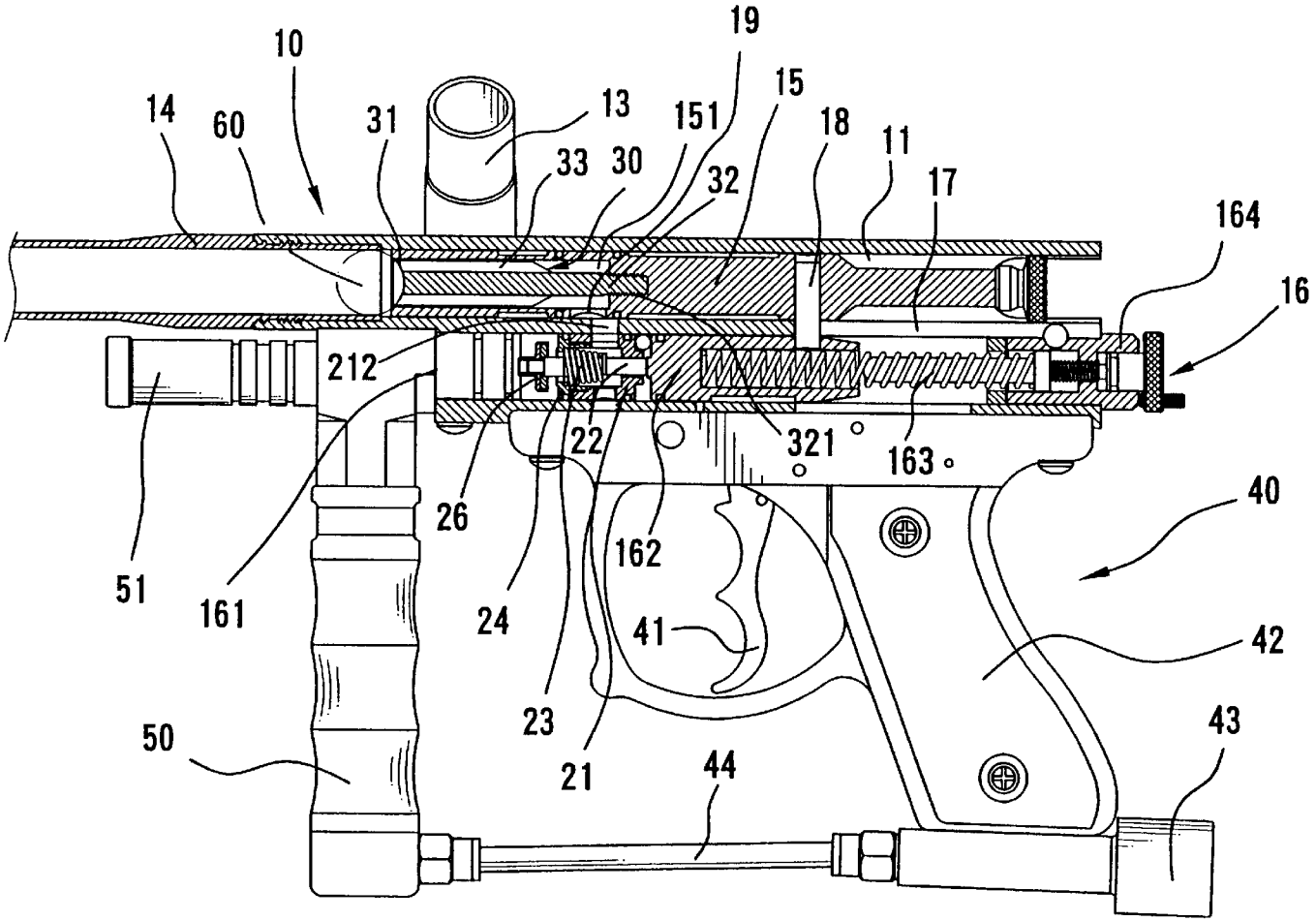
FIG. 5 is a sectional view similar to FIG. 4, illustrating a second stage of firing of the paint ball.
Figure 6:
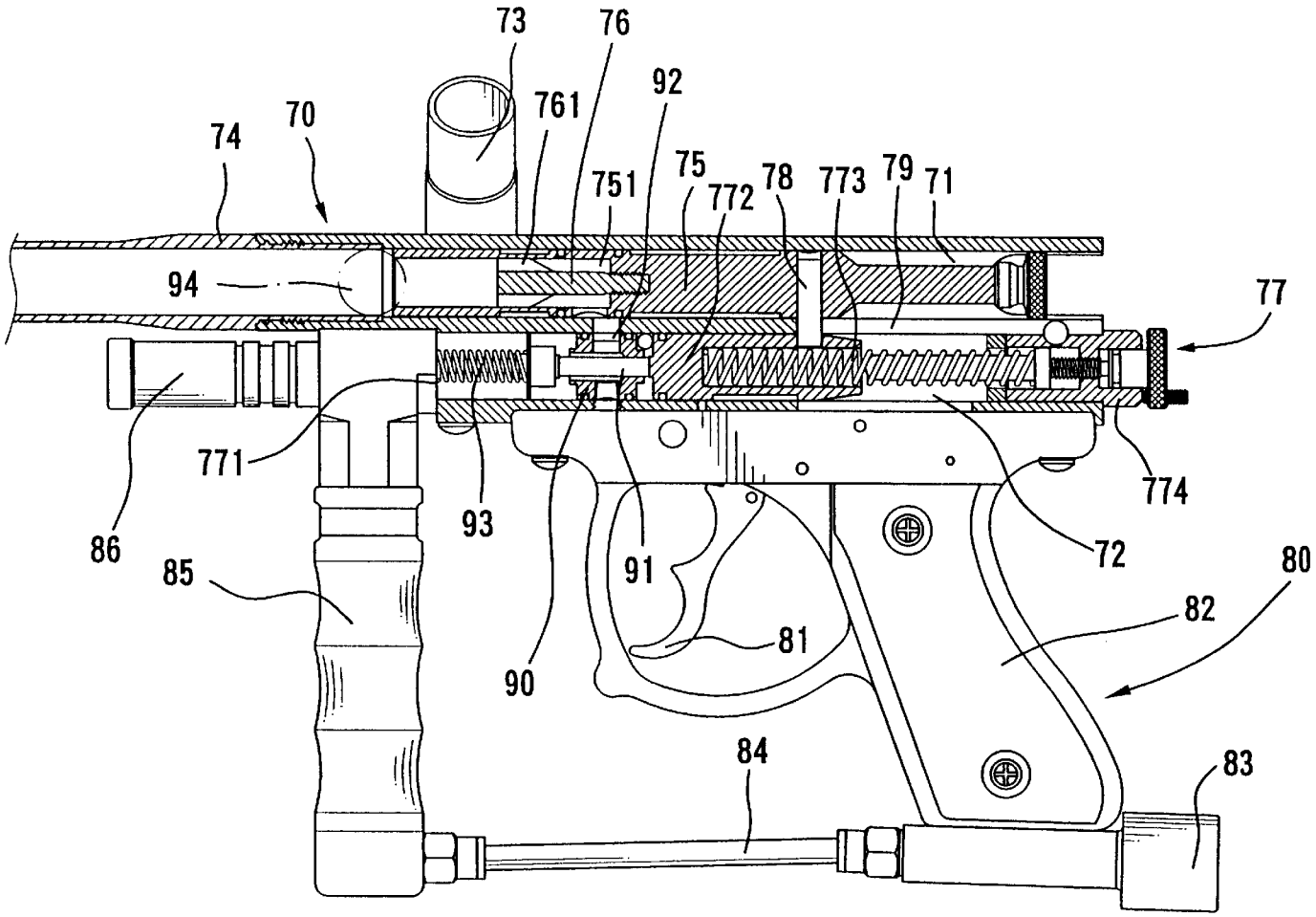
FIG. 6 PRIOR ART
FIG. 6 is a sectional view of a conventional paint ball gun.

In use, referring to FIG. 4, a container (not shown) containing pressurized gas or the like is attached to the adapter 43 such that pressurized gas is fed to the gasifier 50 and the reservioir 51 and then enters a space between the front striker plug 161 and the valve assembly 20. When the trigger 41 is pulled rearward to a firing position, a paint ball 60 is fed into the upper compartment 11 through the ball-feeding tube 13 and thus located in front of the concave face 31 of the venturic bolt pin 30. When triggered, i.e., the trigger 41 is pulled further rearward, the energy stored in the striker spring 163 is released. Thus, the striker 162 moves forward to impact the valve pin 22, which, in turn, causes compression of the valve spring 23 in the positioning sleeve 21 and causes forward movement of the cap 26, as shown in FIG. 5. The pressurized gas enters the valve assembly 20, in which a portion of the pressurized gas enter the chamber 151 in the venturic bolt 15 through the vent 212 of the positioning sleeve 21 and an orifice 19 between the upper compartment 11 and the lower compartment 12, and another portion of the pressurized gas moves through the hole 213 of the positioning sleeve 21 to thereby move the striker 162 rearward. The portion of the pressurized gas entering the chamber 151 passes through the longitudinal passageways 33 of the body 301 to impact the paint ball 60 in front of the venturic bolt pin 30. Thus, the paint ball 60 is fired forward through the barrel 14.

Since the valve spring 23 for opening/closing the cap 26 is mounted inside the positioning sleeve 21 of the valve assembly 20 and extended through by the valve pin 22, a better positioning for the valve spring 23 is obtained. The flexibility problem in the conventional design resulting in the poor accuracy of the fired paint ball is solved. The cap 26 can be opened/closed in an accurate manner, which meets the end of the air tightness and accurate control.

The longitudinal passageways 33 in the body 301 allow uniform output of the pressurized gas for firing the paint ball 60. In addition, the concave face 31 of the body 301 allows intimate contact with the spherical surface of the paint ball 60. Thus, the paint ball 60 is immediately impacted by the pressurized gas exiting the longitudinal passageways 33 of the body 301, moves along a predicted trajectory, and accurately hits the target.

Although the invention has been explained in relation to its preferred embodiment, it is to be understood that many other possible modifications and variations can be made without departing from the scope of the invention as hereinafter claimed.

What is claimed is:

1. A paint ball gun comprising:

a receiver (10) including an upper compartment (11) and a lower compartment (12) parallel to the upper compartment (11);

a barrel (14) attached to a front end of the upper compartment (11);

a ball-feeding tube (13) attached to a side of the receiver (10) for feeding a paint ball (60) into the upper compartment (11);

a bolt (15) slidably mounted in the upper compartment (11) and including a chamber (151) in a front end thereof;

a bolt pin (30) mounted in the chamber (151) of the bolt (15);

a gas control device (16) mounted in the lower compartment (12) and including a front striker plug (161), a valve assembly (20), a striker (162), a striker spring (163), and a rear striker plug (164), the bolt (15) and the striker (162) being connected together to move jointly;

an orifice (19) defined between the upper compartment (11) and the lower compartment (12); and a trigger (41) operably connected to the striker spring (63);

the valve assembly (20) comprising a positioning sleeve (21) secured in the lower compartment (11), a valve pin (22), a valve spring (23) mounted in the positioning sleeve (21), a seal member (24), and a cap (26), the valve pin (22) extending through the valve spring (23) and located in the positioning sleeve (21), the valve pin (22) including a rear end extending beyond a hole (213) in a rear end of the positioning sleeve (21), the positioning sleeve (21) including a front end to which the seal member (24) is mounted, the valve pin (22) including a front end extending beyond the seal member (24) with the cap (26) securely attached to the front end of the valve pin (22) to move therewith;

the valve pin (22) being actuated forward by the striker (162) when the trigger (41) is pulled beyond a predetermined position, the cap (26) being moved away from the seal member (24) to allow gas from the front striker plug (161) to enter the positioning sleeve (21), a portion of the gas entering the chamber (151) of the bolt (15) through the orifice (19) for firing the paint ball (60) through the barrel (14), another portion of the gas exiting the hole (213) in the rear end of the positioning sleeve (21) to move the striker (162) rearward;

the positioning sleeve (21) including an inner threading (211) in a front end thereof and a vent (212) in an outer periphery thereof, the front end of the valve pin (22) including an outer threading (223), the rear end of the valve pin (22) including a beveled section with a beveled face (221) for providing a passageway to the vent (212), a stop (222) being formed on the beveled section, the seal member (24) including a flange (242) on an inner periphery of a front end thereof, the seal member (24) further including a threaded section (241) on an outer periphery thereof for engaging with the inner threading (211) of the positioning sleeve (21), the valve spring (23) including a rear end attached to the stop (222) and a front end attached to the flange (242) of the seal member (24), a washer (25) being mounted around the front end of the valve pin (21) and located in the cap (26), the cap (26) including an inner threading (261) for engaging with the outer threading (223) of the valve pin (22).

2. The paint ball gun as claimed in claim 1, wherein the bolt pin (30) includes a first end and a reduced second end, a conic portion (34) being formed between the first end and the reduced second end of the bolt pin (30), a concave face (31) being defined in the first end of the bolt pin (30), the reduced second end of the bolt pin (30) being securely engaged in the chamber (151) of the bolt (15), at least one longitudinal passageway (33) being defined between the conic portion (34) and the concave face (31) of the bolt pin (30).

* * * * *